United States Patent [19]

Jacobs

[11] 4,154,008

[45] May 15, 1979

[54] HEEL PLATE ARRANGEMENT FOR CROSS COUNTRY SKI BOOT

[76] Inventor: Thomas M. Jacobs, 8 North Rd., Glens Falls, N.Y. 12801

[21] Appl. No.: 875,794

[22] Filed: Feb. 7, 1978

Related U.S. Application Data

[63] Continuation-in-part of Ser. No. 845,304, Oct. 25, 1977, abandoned.

[51] Int. Cl.[2] ..... A43B 5/04; A63C 9/00

[52] U.S. Cl. ..... 36/117; 280/615

[58] Field of Search ..... 36/117, 118, 119, 120, 36/121; 280/611, 613, 614, 615, 634

[56] References Cited

U.S. PATENT DOCUMENTS

| | | | |
|---|---|---|---|
| 2,498,085 | 2/1950 | Lehmkuhl | 36/117 |
| 3,618,233 | 11/1971 | Eie | 36/117 |
| 3,775,866 | 12/1973 | Marker | 36/117 |
| 3,979,131 | 9/1976 | Ginther | 280/615 |

FOREIGN PATENT DOCUMENTS

| | | | |
|---|---|---|---|
| 61783 | 6/1913 | Austria | 280/615 |
| 552399 | 8/1974 | Switzerland | 280/615 |

*Primary Examiner*—Patrick D. Lawson

*Attorney, Agent, or Firm*—Lane, Aitken & Ziems

[57] ABSTRACT

A heel plate arrangement for a cross-country ski boot includes a male member located at the rear of a cross-country ski boot, the forward-most edge of the member being connected to the boot and the rearward-most edge of the member being unobstructed. A female member is sized and shaped to cooperate with and receive the male member, the female member including a vertical slot which is open along the top and at least at the forward-most end. The slot is shaped and has sufficient height, length and width for providing a positive interlock between the male member and slot for restricting lateral movement of the rear portion of the ski boot when the male member is received in the slot.

13 Claims, 12 Drawing Figures

HEEL PLATE ARRANGEMENT FOR CROSS COUNTRY SKI BOOT

This application is a continuation-in-part of my copending application Ser. No. 845,304, filed Oct. 25, 1977, now abandoned.

BACKGROUND OF THE INVENTION

This invention relates to a so-called heel plate arrangement for a cross country ski boot which permits the heel plate of the boot to move vertically relative to the ski and at the same time restricts lateral movement of the boot relative to the ski when the heel is resting on the ski and, more particularly, to such an arrangement which is designed to be effective for downhill maneuvering.

Cross country skiing requires techniques which are significantly different from those utilized in downhill skiing where the ski boot is rigidly fastened to the ski. The cross country skier normally fastens the front portion of his boot to the ski in such a way that the front is a pivot point while the heel is free to move vertically up and down. The vertical freedom of movement of the heel allows for more effective movement on uphill and level terrain. However, when skiing downhill lateral movement of the heel should be restricted so that the skier can turn effectively.

Various arrangements have been proposed and utilized in order to provide this type of connection between the heel of the ski boot and the ski. A typical arrangement is shown in U.S. Pat. No. 3,775,866 to Marker where a pin mounted on the ski is adapted to mate with an opening located in the bottom surface of the heel. This arrangement is unsatisfactory because snow tends to become packed in the opening which significantly reduces the ability of the pin to restrain lateral movement of the heel during sharp turns. A similar arrangement is shown in Austrian Pat. No. 61,783 where an inverted V-shaped member in connected to the ski instead of a pin.

Other types of heel engagement arrangements are shown in U.S. Pat. No. 2,498,085 and Norwegian Pat. No. 77,799 where a groove is located in the heel of the ski boot which can alternately be permanently engaged to the ski or provide a sliding engagement. However, these devices require active intervention by the skier in order to achieve vertical freedom of movement. Further, the opening in the heel has a tendency to fill with snow and reduce the effectiveness of the arrangement.

Another arrangement is shown in U.S. Pat. No. 3,618,233 where the rear edge of the ski boot heel is vertically grooved to cooperate with a flat, tapered, upstanding metal post attached to the ski. This arrangement is designed primarily to locate the ski boot relative to the ski during striding or level terrain cross-country skiing and has little if any ability to prevent overriding or disengagement of the ski boot heel during downhill maneuvering. With the notch located in the heel, in order to provide for sufficient resistance against lateral movement the heel would have to be so radically notched as to destroy or seriously impair its function. Further, in order to provide for any reasonable resistance against wear the heel would be required to be reinforced as shown in the patent.

SUMMARY OF THE INVENTION

In order to solve the problems discussed above, a heel plate arrangement has been designed which utilizes a tab or male member mounted on the ski boot which positively interlocks with a slot or female member mounted on the ski.

The tab can be formed as a projection of the heel of the ski boot which extends beyond the rear edge of the boot or it can be formed within the area of the heel, the rear edge of the heel extending to a point short of the rear edge of the boot and the tab projecting to the rear edge of the boot and being connected along its upper and front edges to the boot.

The female member can be in the form of a pair of blocks connected to the ski and projecting upwardly to form a slot or channel between them. The slot is of a sufficient height, length and width so that when the tab is received into the slot, a positive locking action is achieved and lateral shifting of the heel of the ski boot is prevented.

The inventive arrrangement provides a vertical slot which is open at the top and at least at the forward-most end so that snow cannot become packed within the slot and hinder full insertion of the tab. The tab and slot are sized and shaped so that the tab snugly fits in the slot and surface contact areas between them are provided which are significantly larger than any of those shown in the prior art to provide effective restraint against lateral movement of the heel of the ski boot. The heel is still able to freely move up and down so that there are no restrictions against effective uphill and level terrain handling of the skis.

BRIEF DESCRIPTION OF THE DRAWINGS

For a better understanding of the invention, reference may be had to the following description of several preferred embodiments of the invention, taken in conjunction with the accompanying drawings in which.

DETAILED DESCRIPTION OF SEVERAL PREFERRED EMBODIMENTS

Figure 1:
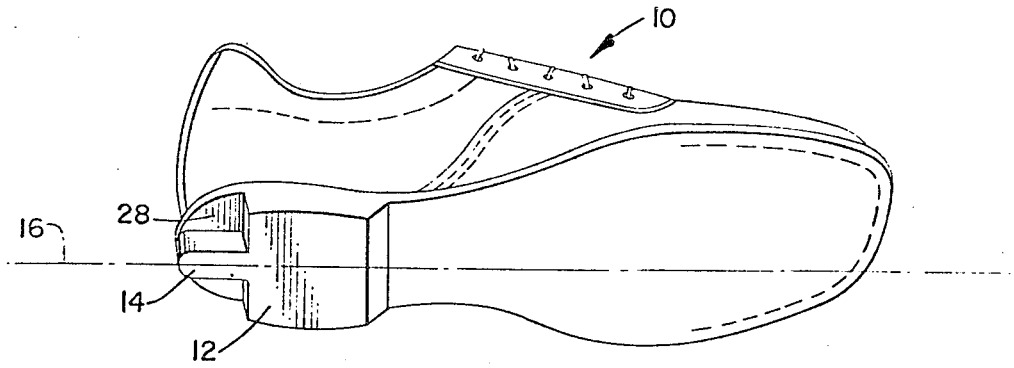
FIG. 1 is a perspective view of a cross-country ski boot which illustrates one embodiment of the invention where the tab is located within the area of the heel.

One embodiment of the invention will be described in conjunction with FIGS. 1–4 where reference numeral 10 is used generally to identify a cross-country ski boot of a typical design. As shown best in FIG. 1, the boot 10 includes a heel 12 which has been shaped to include a male portion or tab 14 which is located within the area normally occupied by a heel. As can be seen, the heel 12 extends to a point which is short of the rear edge of the boot 10. The tab 14 is formed integral with the heel 12 and projects along the axis of the ski boot, the axis being designated by reference numeral 16. The forward edge of the tab 14 is connected to the heel 12 while the rearmost edge is unobstructed.

Figure 2:
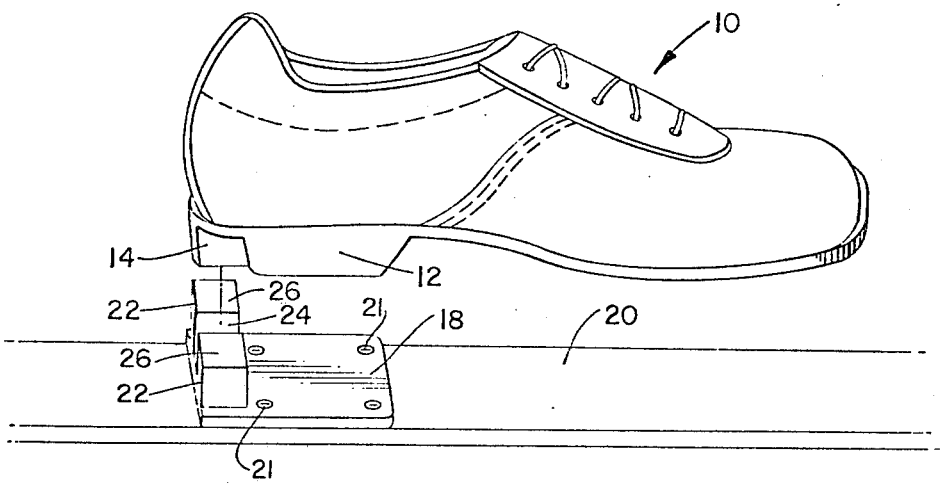
FIG. 2 is a perspective view of the embodiment shown in FIG. 1 which shows the tab and cooperating slot when they are not engaged.
Figure 3:
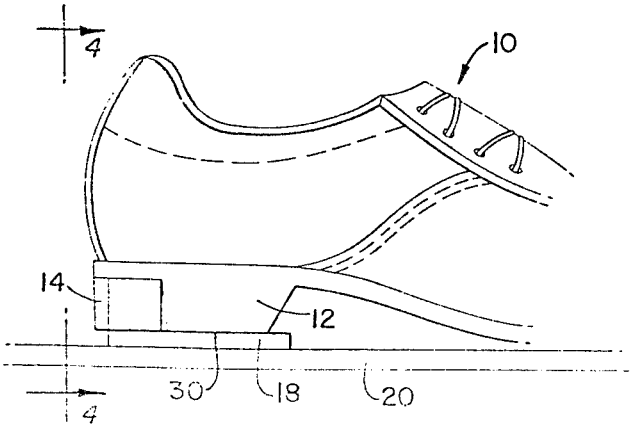
FIG. 3 is a side plan view showing the tab engaged in the slot.

As can be seen in FIG. 2, a plate 18 is mounted on a ski 20 by any suitable means such as screws 21. The plate 18 includes a pair of blocks 22 which project upwardly to form a slot 24 between them. The slot 24 is dimensioned to snugly but freely receive the tab 14 in a positive interlocking relationship, as shown in FIG. 3, so that lateral movement of the heel 12 relative to the ski 20 is prevented. The slot 24 is open at least at its forward-most end and, preferably, at both ends to prevent snow from becoming packed in the slot 24.

The tab 14 can be about ½" (e.g. 1.27 cm.) high, ⅜" (e.g. 0.95 cm.) wide and 1" (e.g. 2.54 cm.) long, and the slot 24 about ½" (e.g. 1.27 cm.) high and 9/16–½" (e.g. 1.43–1.27 cm.) wide. The upper edges of the slot 24 can be slightly mitered for easier and smoother insertion of the tab 14. The sole and heel can be formed integral with each other of a suitable rubber composition material. The heel plate 18 and blocks 22 can be formed as a single unit of a polycarbonate resin sold under the trademark "LEXAN".

Figure 4:
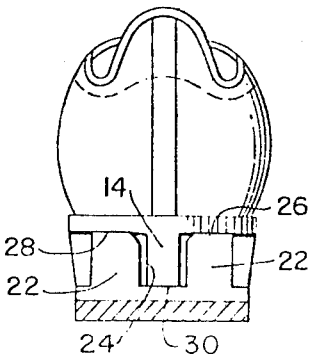
FIG. 4 is a rear plan view of the arrangement shown in FIG. 3.
Figure 5:
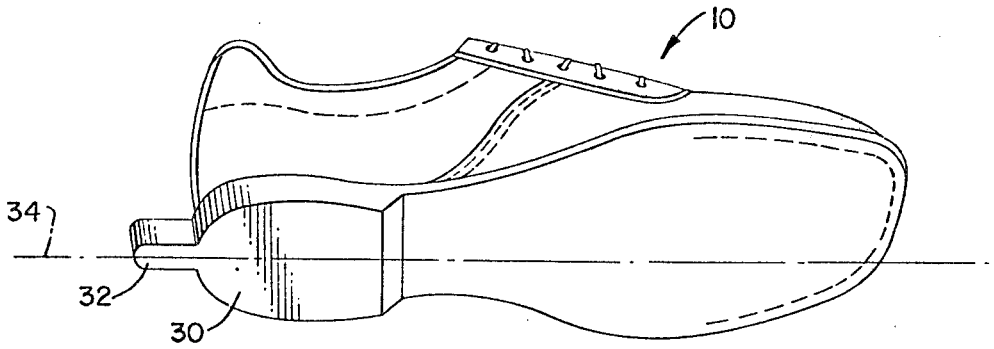
FIG. 5 is a perspective view of another embodiment of the invention where the tab is formed projecting outwardly from the rear edge of the ski boot.

As shown best in FIGS. 3 and 4, upper surfaces 26 of the blocks 22 can simultaneously engage a shoulder 28, which is formed of the portion of the heel 12 which has been carved out in order to form the tab 14, while the bottom surfaces 30 of the heel 12 and tab 14 engage the plate 18. Alternatively, just the surfaces 30 can be designed to engage the plate 18 with no engagement between the surfaces 26 and shoulder 28.

Figure 6:
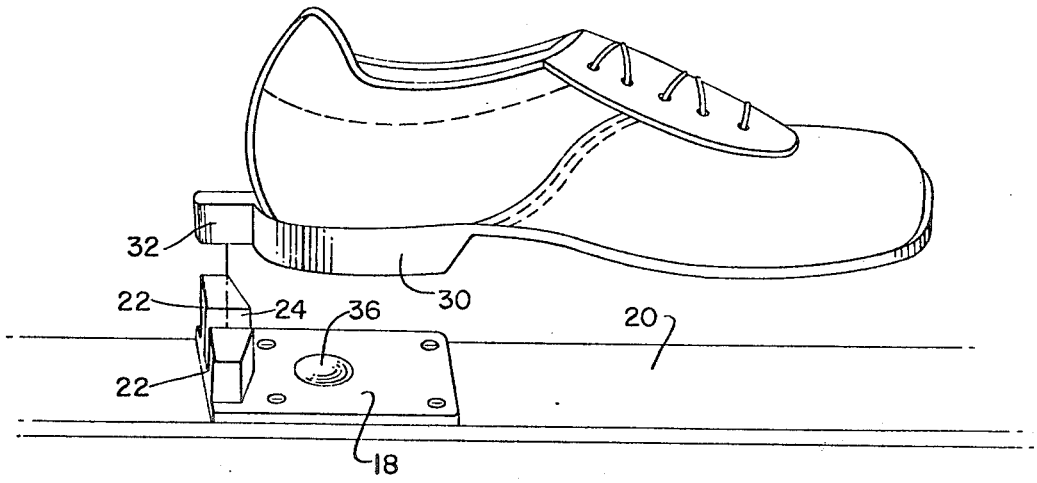
FIG. 6 is a perspective view similar to that of FIG. 2, but showing the embodiment of the invention in FIG. 5.
Figure 7:
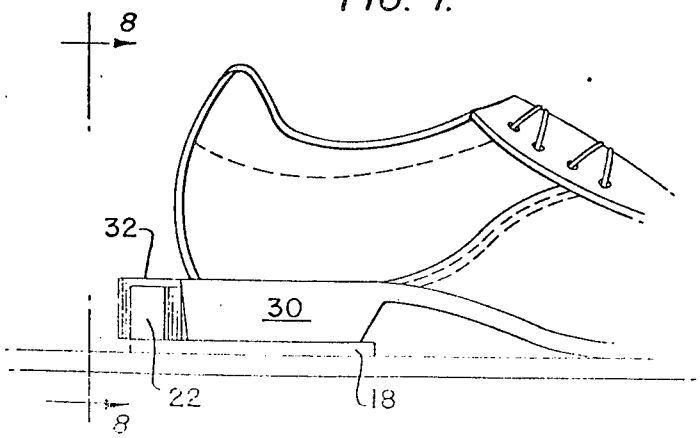
FIG. 7 is a side plan view similar to that of FIG. 3, but showing the embodiment of FIG. 5.
Figure 8:
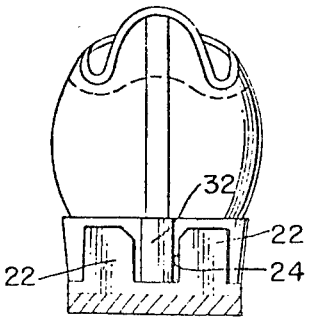
FIG. 8 is a rear plan view similar to that of FIG. 4, but showing the embodiment of FIG. 5.
Figure 9:
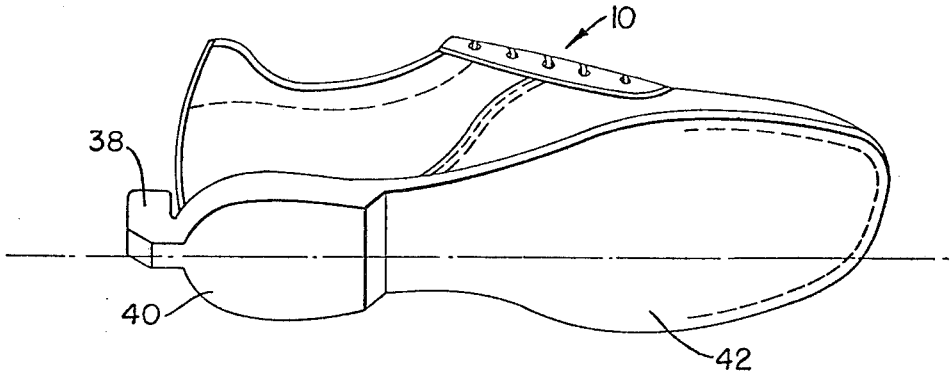
FIG. 9 is a perspective view similar to those of FIGS. 1 and 5, but showing another embodiment of the invention where the tab is formed projecting outwardly from the rear edge of the ski boot and above the upper edge of the heel along the back of the boot and the vertical dimension of the slot is about the same as the height of the tab.
Figure 10:
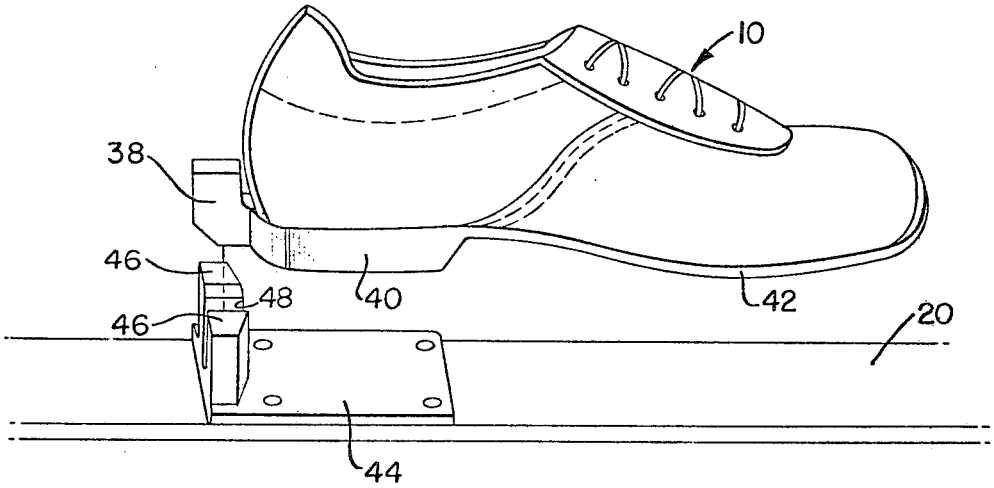
FIG. 10 is a perspective view similar to those of FIGS. 2 and 6, but showing the embodiment of the invention in FIG. 9.
Figure 11:
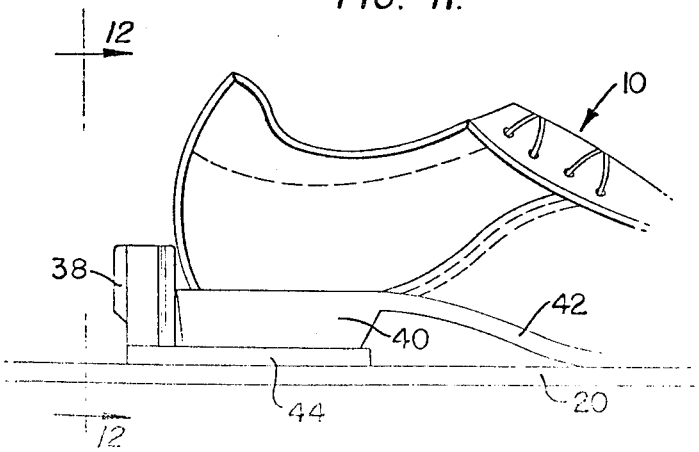
FIG. 11 is a side plan view similar to those of FIGS. 3 and 5, but showing the embodiment of FIG. 9.
Figure 12:
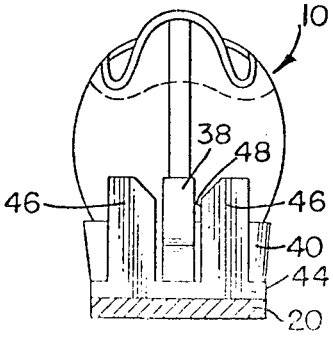
FIG. 12 is a rear plan view similar to those of FIGS. 4 and 8, but showing the embodiment of FIG. 9.

As shown in FIGS. 2–4, the blocks 22 can be rectangular in their horizontal cross-section. However, other suitable shapes can be provided such as, for example, a trapezoidal horizontal cross-section, as shown in FIG. 6, where the longest edge is the one which defines the slot 24 for a greater engagement area between the tab and slot or a streamlined tear drop shape (not shown) for allowing for more efficient movement through the snow.

A second embodiment of the invention is shown in FIGS. 5–8, where the ski boot 10 includes a heel 30 which occupies the entire area normally occupied by a heel. A tab 32 projects outwardly from the rear edge of the heel 30 along the axis 34 of the boot 10. The plate 18, blocks 22 and slot 24 of this embodiment are essentially the same as described in conjunction with FIGS. 1–4, except that the plate 18 can include a domed portion 36 known as a "popper" which compresses and prevents snow build-up under the heel.

The dimensions of the tab 32 and the slot 24 for this embodiment are about the same as mentioned above for the embodiment in FIGS. 1–4. However, because of different wear characteristics of the tab 32, the sole, heel and tab should be formed of nylon. The plate 18 and blocks 22 can be formed of "LEXAN".

As shown in this embodiment, the blocks 22 are formed with a trapezoidal horizontal cross-section, the edges defining the slot 24 being the longest dimension. As can be seen from FIG. 8, the upper inner edges of the blocks 22 can be mitered to provide for easier entry of the tab 32.

A third embodiment of the invention is shown in FIGS. 9–12, which is an improvement over the embodiment shown in FIGS. 5–8, also utilizes a tab 38 which projects outwardly from the rear edge of a heel 40 formed integral with a sole 42. Instead of having a vertical dimension identical to the heel 40, however, the tab 38 projects upward beyond the upper edge of the heel 40 and along but not connected to the back of the ski boot 10. Alternatively, other configurations may be used, for example, where tab 38 projects upwardly beyond the upper edge of the heel 40 and is connected at least at one point along the back of the ski boot 10. The plate 44 is similar in shape to the one shown in FIGS. 5–8, but includes a pair of blocks 46 integral with the plate 44 which have a vertical dimension about the same as that of the tab 38. The upper sides of the blocks 46 which define the slot 48 into which the tab 38 can be inserted are tapered or mitered as shown best in FIG. 12 to provide for easier entry of the tab 38.

Merely by way of example, the sole 42, heel 40 and tab 38 are formed of a single integral unit which can be attached by screws or suitable adhesive to the bottom of the ski boot 10. The sole 42 can be approximately 3/16" to ¼" (e.g. 0.48 cm. to 0.64 cm.) in thickness in its non-heel portion. The tab 38 is molded as an integral part of the sole and heel and extends upwardly along the back of the ski boot 10 about ⅜" to ½" (e.g. 0.95 cm. to 1.27 cm.) above the upper surface of the heel 40 along but not connected to the back of the boot. The lower rear edge of the tab 38 is formed at an angle to facilitate walking and prevent the tab from breaking when the skier is wearing the boot 10 without a ski.

With the arrangement described above, there is sufficient contact between the tab and the slot to prevent the heel from being disengaged from the ski in the lateral direction during downhill maneuvering. A benefit of this design is that the tab can be formed integral with the heel and sole of existing sole materials without the need for costly reinforcement. Similar materials can be used to form the slot, which keep the rate of wear at a minimum.

Relatively high lateral stress can be withstood with the inventive arrangement because of the positive interlock provided by the relatively large surface contact area between the tab and slot. In this way a secure fit is provided which has proved effective in preventing override or disengagement during sharp downhill turns. However, the heel of the boot is at all times free to move upwardly and out of engagement with the slot without any delay to provide for maximum maneuverability, efficiency and safety. Should the skier fall, the heel can freely and quickly be disengaged from the slot regardless of the position of the skier or angle of the ski.

Thus, there is provided in accordance with the invention an arrangement which provides significant advantages over those in the prior art for restricting lateral movement of the heel of a cross-country ski boot while allowing freedom of vertical movement. The embodiments of the invention described above are intended to be merely exemplary of the invention and those skilled in the art will be able to make modifications and variations without departing from the spirit and scope of the appended claims, all such modifications and variations being contemplated as falling within the scope of the claims.

I claim:

1. An interlocking guide for allowing free vertical movement but restricting lateral movement of the heel of a cross-country ski boot, comprising a one-piece, integrally formed sole and heel, a male member located at the rear of a cross-country ski boot, the forward-most edge of the member being formed integral with the heel and the rearward-most edge of the member being unobstructed, a female member sized and shaped to cooperate with and receive the male member, the female member including slot means for forming a vertical slot which is open along the top and at least at the forward-mode end, connecting means for connecting the slot means to a ski, the slot being shaped and having sufficient height, length and width for providing a positive interlock between the male member and slot for restricting lateral movement of the rear portion of the ski boot when the male member is received in the slot.

2. The arrangement in claim 1, wherein the male member projects outwardly from the rear of the boot.

3. The arrangement in claim 1, wherein the male member projects upwardly beyond the upper edge of the heel along but not connected to the rear edge of the ski boot.

4. The arrangement of claim 1, wherein the rear edge of the heel extends to a point short of the rear edge of the boot and the rear edge of the male member projects to the rear edge of the boot.

5. The arrangement in claim 1, wherein the slot has essentially the same height, length and width as the male member.

6. The arrangement in claim 5, wherein the upper edges of the slot are tapered outwardly to accommodate easier insertion of the male member.

7. The arrangement in claim 1, wherein the male member and slot are co-axial with the boot.

8. The arrangement in claim 1, wherein the slot means includes a plate and a pair of blocks projecting upwardly therefrom.

9. The arrangement in claim 8, wherein the slot and male member are sized so that when the member is inserted in the slot, the bottom surface of the heel will engage the upper surface of the plate.

10. The arrangement in claim 8, wherein the blocks have a rectangular horizontal cross-section.

11. The arrangement in claim 8, wherein the blocks have a trapezoidal horizontal cross-section with the longest of the parallel sides defining the slot.

12. The arrangement in claim 1, wherein the slot is open along its full height at both ends.

13. The heel plate arrangement in claim 1, wherein the tab projects upwardly beyond the upper edge of the heel and is connected at least at one point to the rear edge of the ski boot and the slot is substantially the same height as the tab.

* * * * *

UNITED STATES PATENT AND TRADEMARK OFFICE

CERTIFICATE OF CORRECTION

PATENT NO. : 4,154,008

DATED : May 15, 1979

INVENTOR(S) : Thomas M. Jacobs

It is certified that error appears in the above-identified patent and that said Letters Patent are hereby corrected as shown below:

Column 5, line 22, "mode" should be -- most --.

Signed and Sealed this

*Eleventh* Day of *September 1979*

[SEAL]

*Attest:*

*Attesting Officer*

LUTRELLE F. PARKER

*Acting Commissioner of Patents and Trademarks*